US006088955A

United States Patent [19]

Nelson, Jr. et al.

[11] Patent Number: 6,088,955

[45] Date of Patent: Jul. 18, 2000

[54] MEMORIAL HAVING BUILT-IN RECEPTACLE

[76] Inventors: James E. Nelson, Jr.; Patricia A. Nelson, both of 2424 N. 9th St., West Monroe, La. 71291

[21] Appl. No.: 09/168,071

[22] Filed: Oct. 8, 1998

[51] Int. Cl.[7] ..... E04H 13/00; A01G 5/00

[52] U.S. Cl. ..... 47/41.1; 47/41.14; 52/103; 40/124.5; 248/128

[58] Field of Search ..... 52/103; 40/124.5, 40/725; 47/41.1, 41.14, 41.01, 39; 248/128

[56] References Cited

U.S. PATENT DOCUMENTS

| | | | |
|---|---|---|---|
| 1,924,149 | 8/1933 | Britton | 47/41.1 |
| 2,276,749 | 3/1942 | Vanderveer | 40/124.5 X |
| 2,608,028 | 8/1952 | Ross | 47/41.1 |
| 2,638,717 | 5/1953 | Weaver | 47/41.1 |
| 3,312,014 | 4/1967 | Pfister | 47/41.1 |

*Primary Examiner*—Robert Canfield
*Attorney, Agent, or Firm*—Rothwell, Figg, Ernst & Manbeck

[57] ABSTRACT

A improved memorial for cemeteries and other applications includes a marker with a receiving hole for accommodating a receptacle in a stored position. The receptacle has a length extending along a first axis with at least one concavity or bore extending along said first axis. The receptacle is retained in the receiving hole in the stored position of the receptacle with the first axis generally parallel to a broad viewing surface of the marker. The memorial has substantial advantages over existing memorials, including increased longevity and reduction in damages, costs and delivery problems experienced with existing memorials.

9 Claims, 10 Drawing Sheets

MEMORIAL HAVING BUILT-IN RECEPTACLE

BACKGROUND OF THE INVENTION

1. The Field Of The Invention

The present invention relates generally to memorials, such as memorial plaques and the like, and in particular to memorials having receptacles, such as receptacles for flowers or the like. The preferred embodiments of the present invention involve a new way of mounting a receptacle—such as a flower vase or the like—on a memorial.

2. Description Of The Related Art

Memorials, such as memorial plaques and the like, are used in a variety of circumstances. Memorials can serve, for example, as remembrances of persons or events. Often, memorials are used as remembrances of persons that have passed away, such as in cemeteries and the like. Such memorials typically include written indicia identifying the deceased person. It has also been a common practice to place flowers upon memorials in memory of the deceased.

FIG. 1 shows a known memorial that is currently used in the art. This structure is placed upon the ground G as a memorial to a deceased individual. The memorial includes a foundation 10 (made for example with concrete, granite, plastic, composite or the like) and a marker plate 20 (made for example with an ornamental metal such as bronze or the like) having indicia 25 printed and/or engraved thereon identifying the individual that the memorial is in tribute to. A vase 30 is also included in order to place flowers at the memorial site. In order to store the vase 30, a vertical through-hole H is formed completely through both the plate 20 and the foundation 10. The vase 30 is about 6 to 8 inches tall, which is typically greater than the thickness of the plate 20 and the foundation 10 combined, so that the ground beneath the foundation is typically dug out to receive the vase in its inverted/stored state. A plastic canister or cup (not shown) is located within the hole H to receive the vase. The plastic canister has a hole in its floor to provide a drainage passage. When not in use, the vase 30 is turned upside down and inserted into the canister inside the hole H.

Although these known memorials have found wide acceptance in the industry, there are still a variety of problems with this known structure. First, these memorials are undesirable because they compromise the integrity of the memorial's foundation by (1) requiring a hole to be made through the foundation which compromises the structure of the foundation and by (2) requiring the ground beneath the foundation to be dug out which compromises the support from the underlying ground surface. As a result, the foundation is readily subject to damage. In addition, because the storage area for the vase inside the hole H extends into the ground surface, there are increased chances of dirt/water contamination or the like within the canister.

This damage and/or contamination is very undesirable because memorials should maintain pleasing appearances and should endure for long periods of time in remembrance of those being memorialized. Damage and/or contamination is also very undesirable because it can increase costs required to maintain the memorials, creating problems for the family of the deceased and/or for those purchasing or caring for such memorials.

In addition, this structure, including the vertical hole H, is relatively complicated and difficult to construct. For example, the structure requires the formation of holes in the ground and in the foundation and requires coordination and alignment of these holes which can also result in undesirable cost increases.

SUMMARY OF THE INVENTION

The present invention overcomes the above and other problems in the art. In the most preferred embodiments of the invention, the memorial includes a receptacle, such as for example a vase for flowers, supported by a marker plate.

According to a first embodiment of the invention, a memorial is provided that includes: a) a marker having a generally narrow height and a broad viewing surface with memorial markings thereon; b) a receiving hole in the marker for accommodating a receptacle in a stored position; c) a receptacle having a length extending along a first axis with at least one concavity or bore extending along the first axis, the receptacle being retained in the receiving hole in the stored position of the receptacle with the first axis generally parallel to the broad viewing surface; and d) the receptacle being movable to an erect position wherein the receptacle extends from the receiving hole.

In one exemplary embodiment, the receiving hole is a lateral bore in the marker, the lateral bore extending generally parallel to the broad viewing surface. In another exemplary embodiment, a cover plate is provided for covering at least a portion of the receptacle in the stored position. The memorial preferably also includes a foundation upon which the marker is mounted According to another aspect of the invention, a method of maintaining a receptacle on a memorial is provided having the steps of: a) providing a marker having a generally narrow height and a broad viewing surface with memorial markings thereon; b) providing a receiving hole in the marker; c) providing a receptacle having a length extending along a first axis with at least one concavity or bore extending along the first axis; d) storing the receptacle in the receiving hole in a stored position with the first axis generally parallel to the broad viewing surface; and d) moving the receptacle to an erect position wherein the receptacle extends from the receiving hole.

Among other things, the preferred embodiments of the invention can provide a number of notable advantages. For example, the preferred embodiments can be particularly advantageous in cemetery applications. The preferred embodiments enable, for example, the seller (e.g., the cemetery, etc.) to counter market old nonfunctional products with the present new technology. The preferred embodiments also require less labor for assembly. The preferred embodiments also require fewer costs (labor and material costs) to assemble. The preferred embodiments also greatly reduce maintenance costs of memorials, such as grave sites, over time by greatly inhibiting ground shift and washing. The preferred embodiments can also greatly inhibit breaking of granite foundations (as well as other foundations) due to the omission of a weakening vase hole. The preferred embodiments also allow for storage of a receptacle such as a vase (e.g., at a cemetery site or the like) in substantially less space than previously required.

The preferred embodiments of the present invention also enable costs involved in shipment of markers and vases to be substantially reduced. In this regard, markers, vases and plastic canisters therefor are typically separately packaged which creates difficulties in delivery and handling. In contrast, the preferred embodiments of the present invention can have a marker and a receptacle therefor packaged, handled and delivered together in simple packaging—greatly facilitating handling, delivery and related costs.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention will become more fully understood from the detailed description given hereinbelow and the accompanying drawings which are given by way of illustration only, and are not limitative of the present invention, and wherein.

DETAILED DESCRIPTION OF THE PREFERRED EMBODIMENTS

FIGS. 2(A)–2(D) show a first embodiment of the invention having a foundation 100 and a marker plate 200. The foundation 100 can be made of any known material that can be used for creating such a foundation. Exemplary materials include concrete, granite, plastics, composites and any other suitable materials. The marker 200 can also be made of any suitable rigid material. Most preferably, however, the marker 200 is made with a metal material such as bronze or the like. The marker is preferably a solid piece of material to provide strength and longevity.

Figure 1:
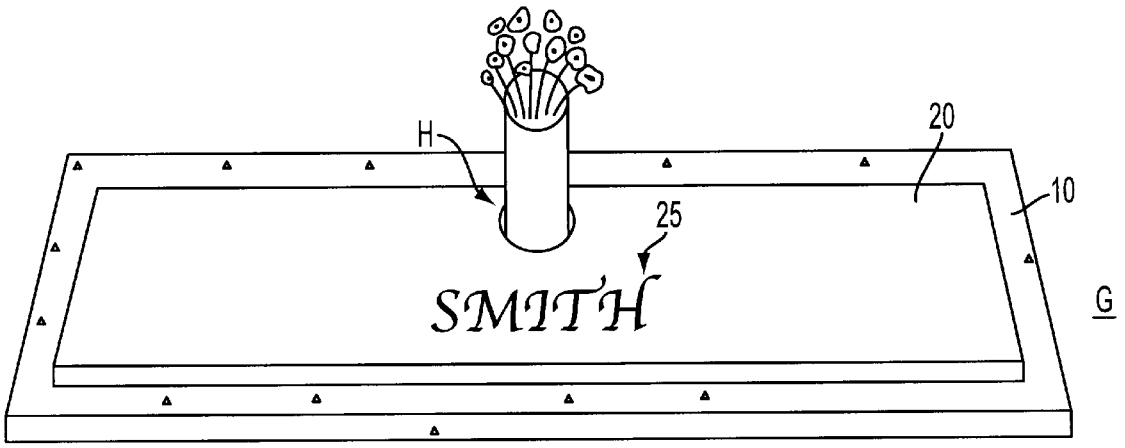
FIG. 1 PRIOR ART
FIG. 1 is a perspective view of a conventional memorial having a vase that fits within a vertical hole drilled through the marker and the foundation.
Figure 2C:
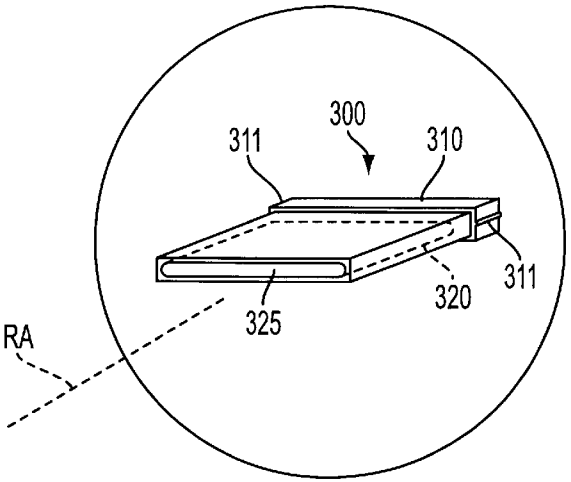
FIG. 2(C) is a perspective view of a receptacle for use in the memorial shown in FIG. 2(A) according to one embodiment thereof.
Figure 2D:
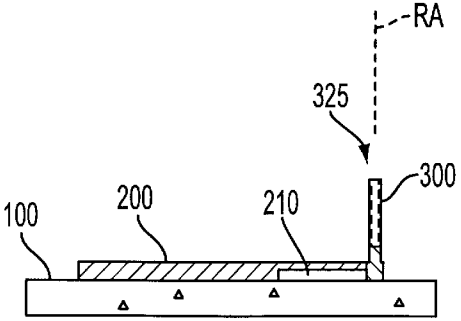
FIG. 2(D) is a cross-sectional side view of the memorial according to the first embodiment of the invention taken along the arrows A—A shown in FIG. 2(B)
Figure 2A:
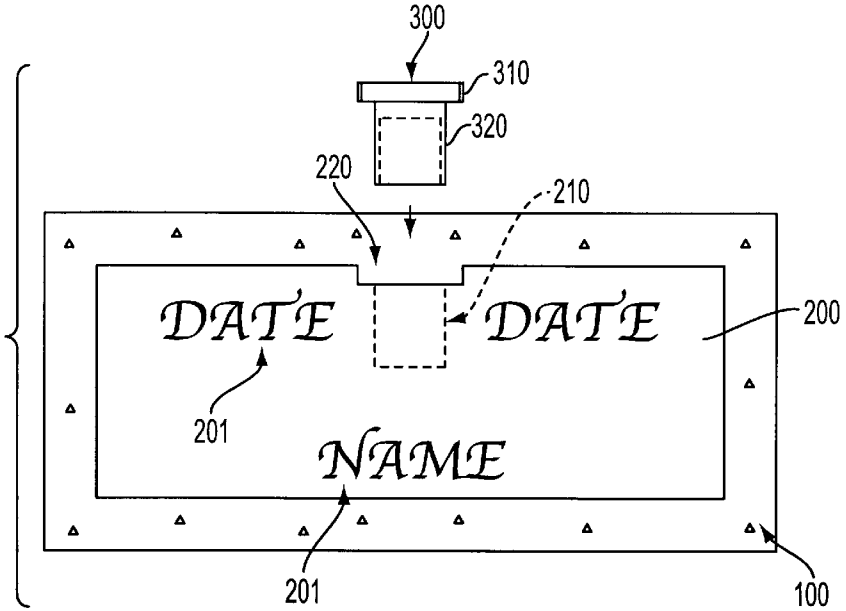
FIG. 2(A) is a top view of a memorial according to a first embodiment of the invention having a lateral side bore for receiving a receptacle, with a receptacle shown removed from the lateral side bore.

In this first embodiment, the foundation 100 preferably has a substantially rectangular shape and a relatively small vertical height h1, and the marker preferably has a substantially rectangular shape and a relatively small vertical height h2. Although these rectangular shapes are preferred in certain applications, the marker and the foundation can have any desired shape. In the most preferred embodiments, the marker 200 and the foundation 100 are generally thin or flat as shown. In some preferred examples, the marker can have a height h2 of between about ⅝ inch and 2 inches. The height h2, however, can vary greatly depending on circumstances. In less preferred embodiments, for example, the marker can have a very large vertical height h2. Similarly, the height h1 can be varied as desired. As shown in FIG. 2(A), the marker 200 also preferably includes markings 201 such as illustrations, indicia identifying dates or names, etc., or other information. These markings can be printed, engraved or otherwise formed on the marker. In preferred embodiments for cemetery use, these markings include indicia identifying an individual's name, lifetime dates, and other desired information.

As shown in dotted lines in FIG. 2(A), the marker 200 includes a lateral bore 210. The bore 210 is configured to receive the receptacle 300. As best shown in FIG. 2(C), the receptacle 300 preferably includes a widened base 310 and a narrower receiving member 320. The receiving member 320 is configured to fit within the bore 210 while the base 310 is configured to fit within the lateral cutout 220 at the side of the marker 200. The base 310 is most preferably sized to fit snugly within and fill the cutout 220 so that the marker 200 has a smooth rectangular appearance when the receptacle is stored within the bore 210.

Figure 2B:
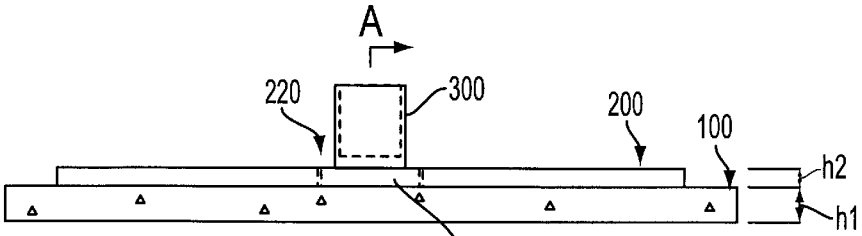
FIG. 2(B) is a side view of the memorial shown in FIG. 2(A) with the receptacle in an erect position on the marker.
Figure 3C:
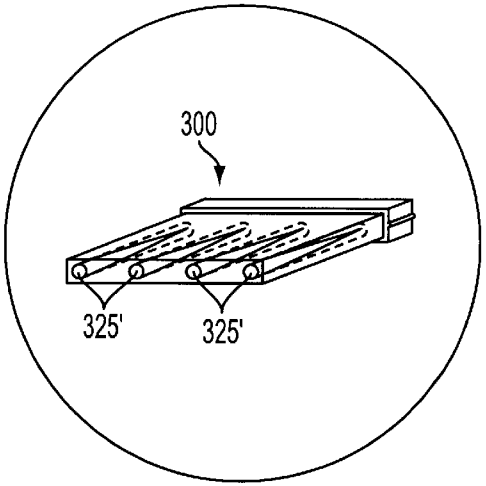
FIG. 3(C) is a perspective view of a receptacle for use in the memorial shown in FIG. 3(A) according to one embodiment thereof.
Figure 3D:
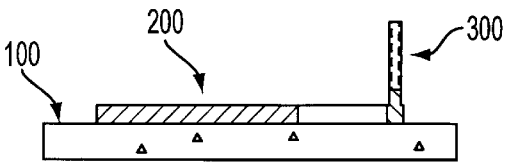
FIG. 3(D) is a cross-sectional side view of the memorial taken along the arrows A—A shown in FIG. 3(B)
Figure 3A:
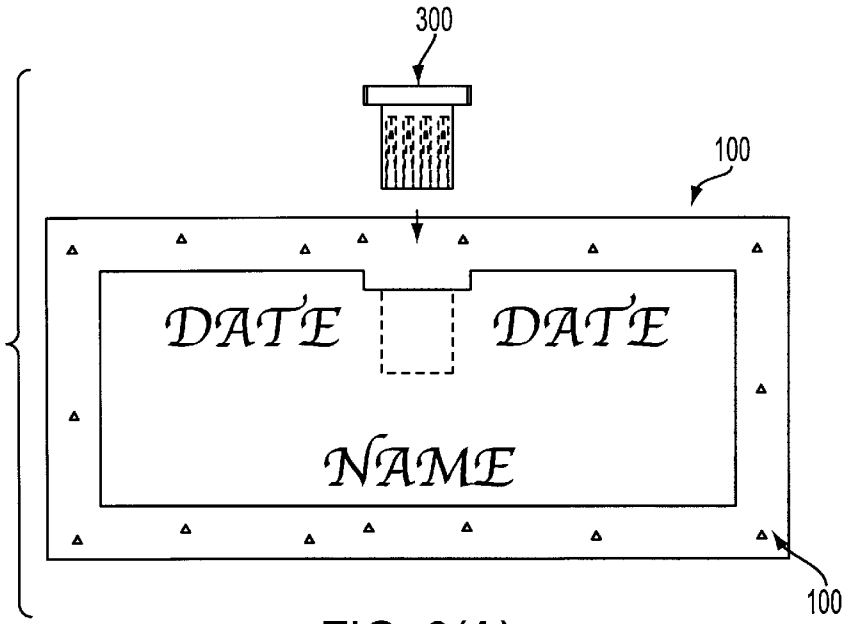
FIG. 3(A) is a top view of a memorial according to a modification of the first embodiment of the invention shown in FIG. 2(A) having a lateral side bore for receiving a receptacle, with a receptacle shown removed from the lateral side bore.
Figure 3B:
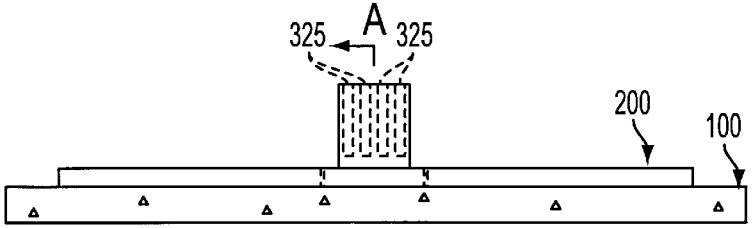
FIG. 3(B) is a side view of the memorial shown in FIG. 3(A) with the receptacle in an erect position on the marker.

To erect the receptacle 300 to hold flowers or the like, the receptacle is first removed from the bore 210. Then, the receptacle is rotated about 90 degrees and the base 310 is inserted into the cutout 220 with the receiving member 320 facing upward as shown in FIGS. 2(B) and 2(D). As shown in FIG. 2(B), the base 310 preferably also fits snugly within the cutout 220 when in this erect position. In this erect position, the concavity 325 of the receiving member 320 extends generally vertically to hold flowers or the like.

FIGS. 3(A)–3(D) illustrate a modification of the embodiment shown in FIGS. 2(A)–2(D) wherein the receiving member 320 of the receptacle includes a plurality of elongated bores 325' instead of the single wide concavity 325 of the first embodiment. It is contemplated that the receptacle 300 can be made to have a variety of shapes. In another exemplary embodiment, for example, the receptacle 300 could have a single elongated tubular receiving member 320 to receive a single flower stem or the like. This latter embodiment is particularly advantageous when the size of the memorial is minimized, such as in niches within crypts or mausoleums or in other applications. It is contemplated that a great variety of other configurations can also be used.

In order to enhance the stability of the receptacle 300 once erected, means are preferably provided for stabilizing the receptacle in the erect position. Any means for stabilizing can be used, such as bolts, clamps, pins, or the like.

Figure 4:
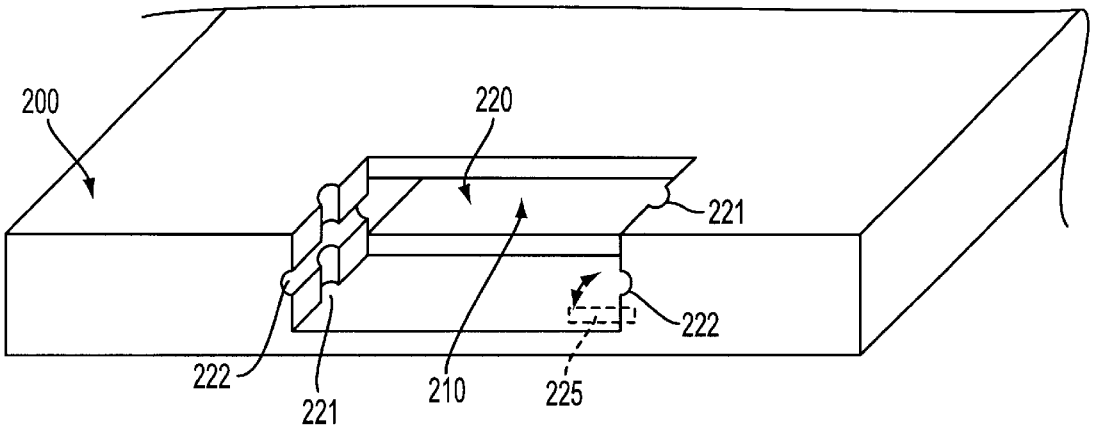
FIG. 4 is a perspective view illustrating a portion of the marker for receiving and supporting a receptacle according to one embodiment of the invention.

A first exemplary embodiment of the stabilizing means is shown in FIGS. 2(C) and 4, wherein the base 310 has flanges 311 that extend from opposite sides that cooperate with vertical grooves 221, FIG. 4, that receive and guide the flanges 311 and horizontal grooves 222 that allow the base 310 to laterally slide into its stored position.

FIG. 4 also shows a second exemplary embodiment of the stabilizing means which includes a pin 225 mounted on the marker 200 in a manner to move into engagement with the base 310 when the receptacle is placed in its erect position. The pin 225 can be made to either pivot downward as shown by the arrow in FIG. 4, to slide laterally, or to otherwise move into engagement. It should be understood that the first and second exemplary embodiments of the stabilizing means shown in FIG. 4 can be implemented together or separately. The stabilizing means can also merely be the three walls of the marker inside the cutout 220 which can provide at least some stability to the receptacle.

Figure 5:
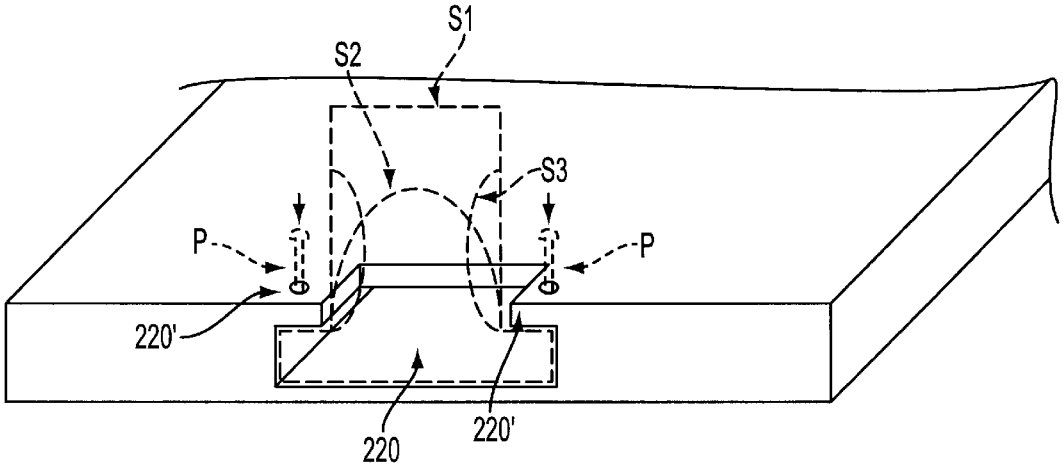
FIG. 5 is a perspective view illustrating a portion of the marker for receiving and supporting a receptacle according to another embodiment of the invention.

FIG. 5 shows an alternative embodiment of the stabilizing means wherein the cutout 220 includes overhanging tabs 220'. In this embodiment, the receptacle 300 is laterally slid into and out of the bore 210 in a similar manner, but the base 310 is received beneath the tabs 220' when the receptacle is in a vertical position. As shown in FIG. 5, additional support pins P can also be included that extend through holes in the tabs 220' into holes (not shown) in the base 310 to securely retain the receptacle 300.

FIG. 5 also illustrates that, as discussed above, the receiving member 320 of the receptacle 300 can have a variety of shapes—such as, as just some examples, rectangular S1, rounded S2, or tapered S3. The receiving member 320 can have any desired shape as long as it can be received within the bore 210.

Figure 6:
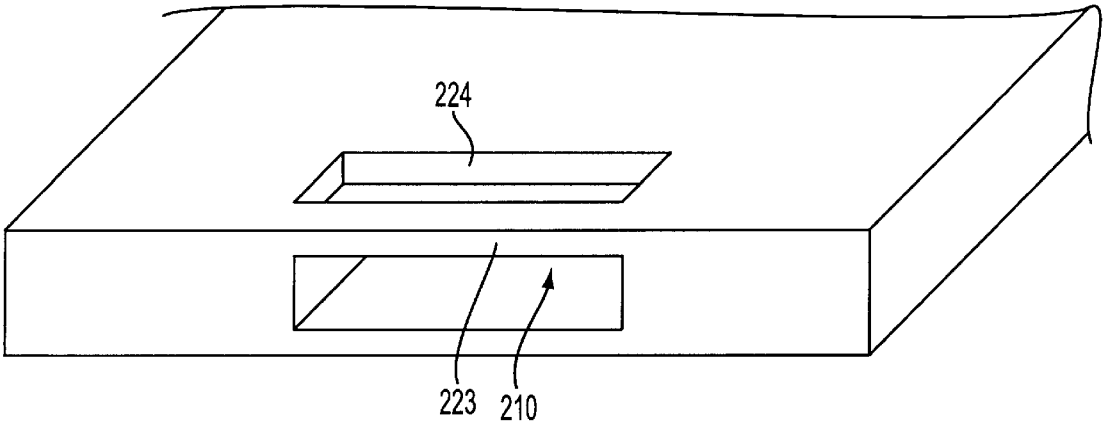
FIG. 6 is a perspective view illustrating a portion of the marker for receiving and supporting a receptacle according to yet another embodiment of the invention.

FIG. 6 shows another alternative embodiment wherein the cutout 220 is modified to include a lateral side beam 223 which can retain the base 310 of the receptacle from moving laterally. In order to erect the receptacle 300, it is first laterally removed from the bore 210. Then, the receiving member 320 is rotated to a vertical position and the base 310 is dropped into the top opening 224 so that the beam 223 retains the receptacle in the top opening.

Figure 7:
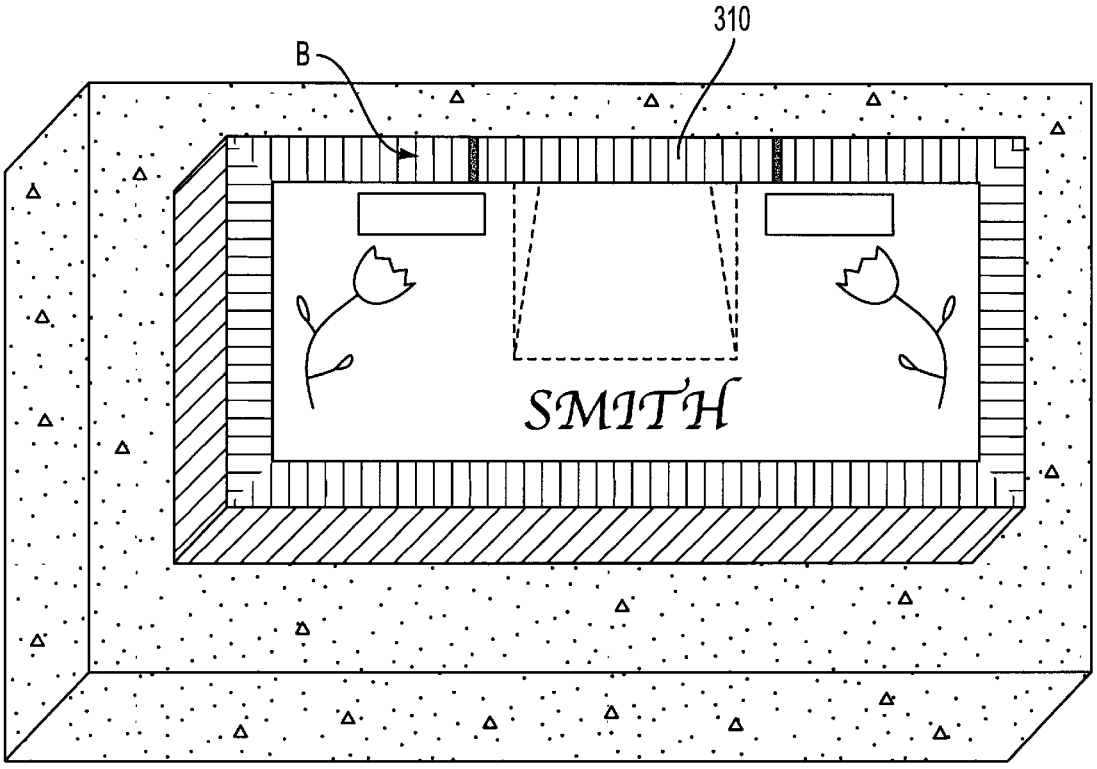
FIG. 7 is a perspective view of an embodiment of the invention having a receptacle base that visually blends in with a border around the marker.

FIG. 7 shows another embodiment of the invention wherein the base 310 is sized to be the same width as and to contain the same markings as an ornamental border B around the perimeter of the marker 200 so that the base 310 blends in when in a stored position as shown. The base can also be constructed and marked so that upon rotating the receptacle 300 to an erect position as discussed above, the border B is maintained around the receiving member 320 despite the rotation of the base 310.

Figure 8:
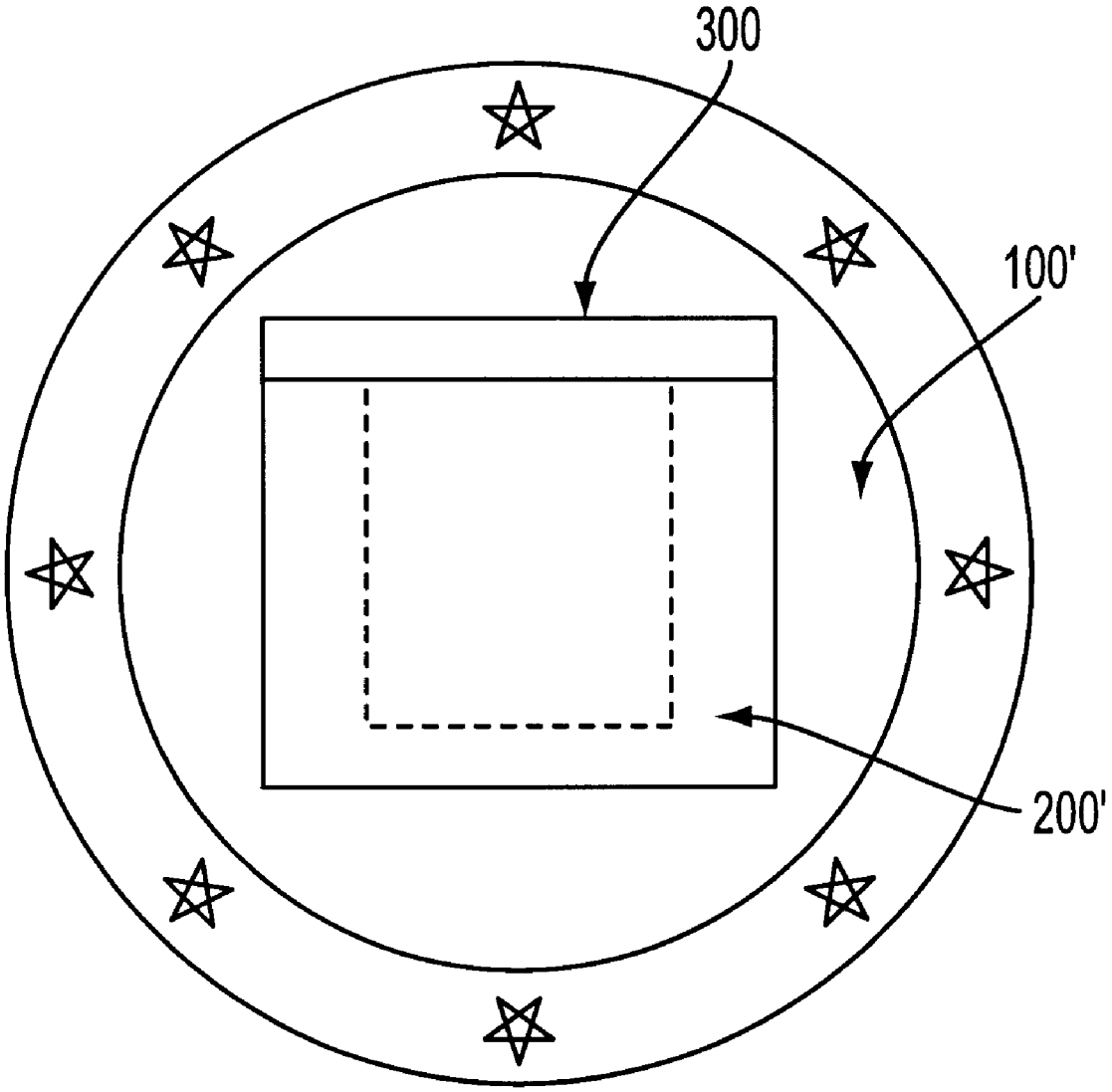
FIG. 8 is a top view of an embodiment of the invention having a round configuration.

FIG. 8 illustrates another exemplary embodiment of the invention wherein the memorial has a circular base 100' with a rectangular receptacle-holding marker 200' thereon.

Figure 9:
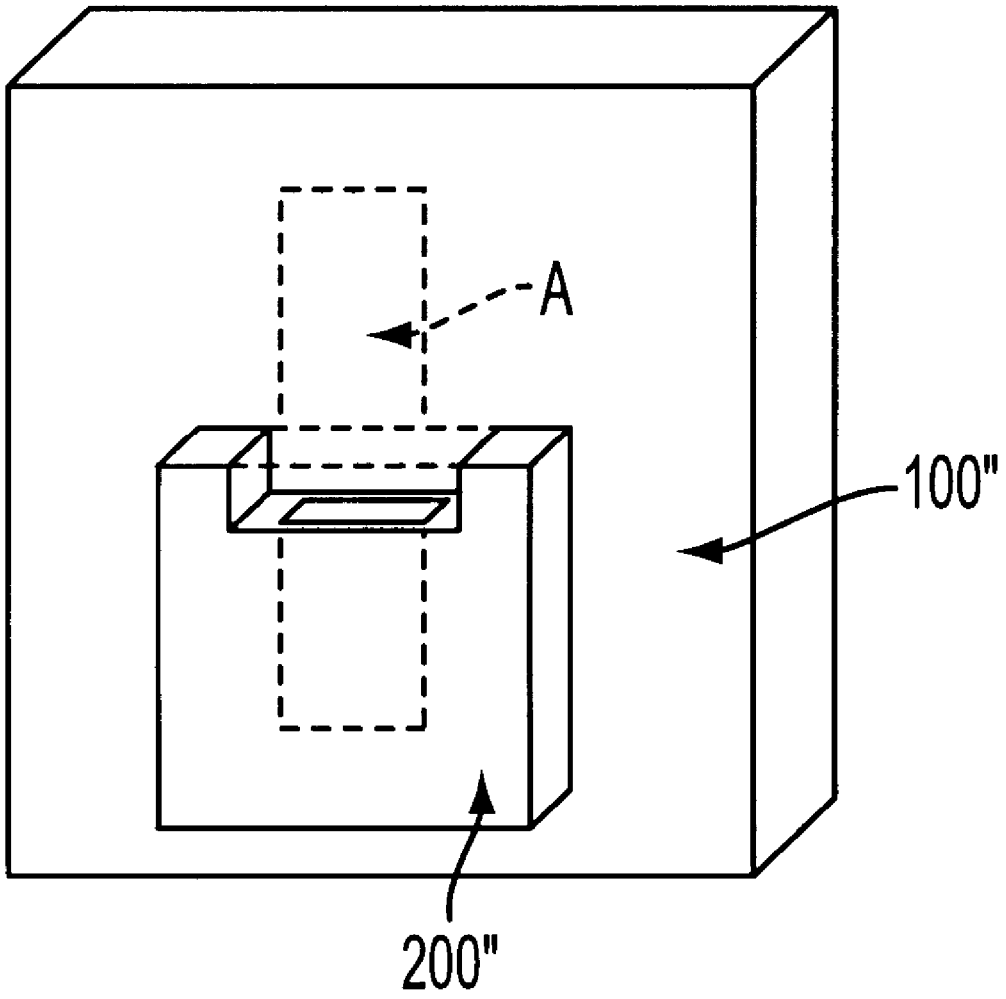
FIG. 9 is a perspective view of an embodiment of the invention wherein the foundation and marker are oriented vertically.

FIG. 9 illustrates another exemplary embodiment of the invention wherein the memorial has a rectangular base 100" with a rectangular receptacle-holding marker 200" thereon. In the embodiment shown in FIG. 9, the base 100" is oriented vertically as shown. In this regard, the receptacle 300 can be initially stored within the bore 210", but can assume an erect position A, as shown, that is generally parallel to the generally vertical plane of the member 100" rather than generally perpendicular thereto. It is contemplated that, where applicable, other embodiments herein can also be modified to have their marker and base oriented vertically in a similar manner. The use of such an orientation of the marker and base can be desirable, for example, for use in crypts, mausoleums or the like applications.

In the embodiments shown in FIGS. 2–9, the receptacles 300 are slid laterally into the marker 200. Each of the above-noted embodiments can be modified, if desired, to include means to facilitate such insertion, such as for example guide tracks, drawers that are laterally pulled from the marker, or the like. In order to reduce costs, however, preferred embodiments do not include such guide tracks, drawers or the like.

In the embodiments shown in FIGS. 2–9, in their stored positions, the receptacles preferably have receiving members 320 that extend generally along axes RA, see for example FIGS. 2(C) and 2(D), that are generally parallel to the broad surface, i.e., the broad viewing surface, of the marker. Preferably, the receiving members 320 have concavities or receiving bores extending generally parallel to the broad viewing surface which can receive flower stems or the like when the receptacle is erected. In this manner, when the marker has a minimal height h2, a receptacle 300 having a substantial size can still be retained within the marker 200.

Figure 10A:
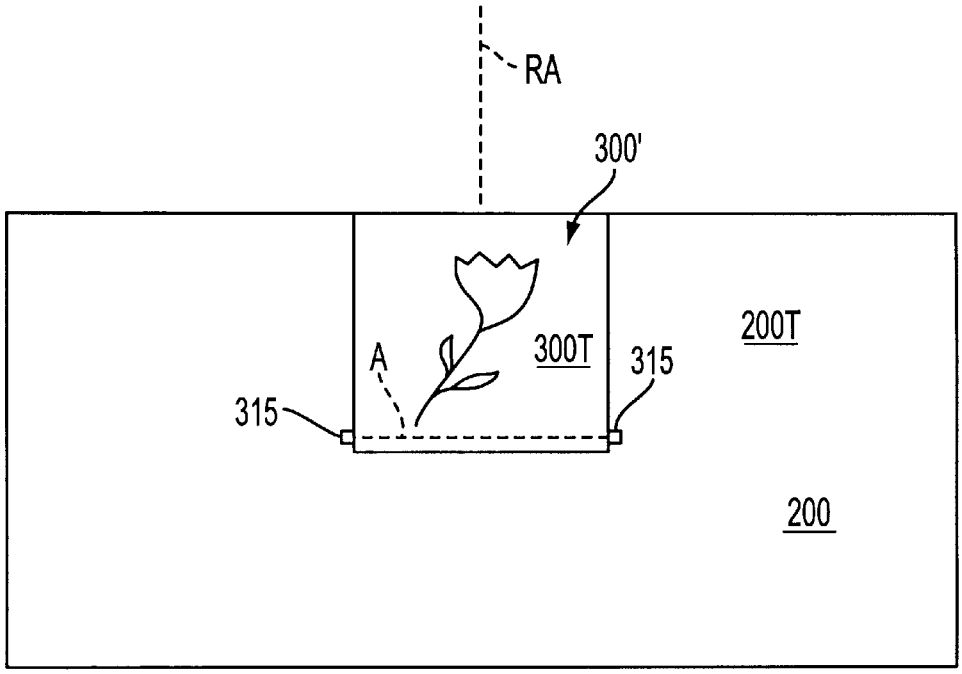
FIG. 10(A) is a top view of another embodiment of the invention having a pivoted receptacle received within a corresponding top recess in the marker.

FIG. 10(A) shows another embodiment of the invention wherein the marker 200 includes a built-in receptacle 300' that is pivoted from a stored position as shown to a vertical position (not shown) for retaining flowers or the like. In this regard, the receptacle 300' can include for example pivot pins 315 that fit within pivot holes to allow the receptacle to pivot around the axis A. Preferably, a generally horizontal top surface 300T of the receptacle 300 is generally flush with a generally horizontal top surface 200T of the marker 200. Alternatively, the top surface 300T can be raised slightly above the top surface 200T or can even be slightly recessed there below. Among other things, raising the top surface 300T can facilitate manual handling of the device.

Figure 10B:
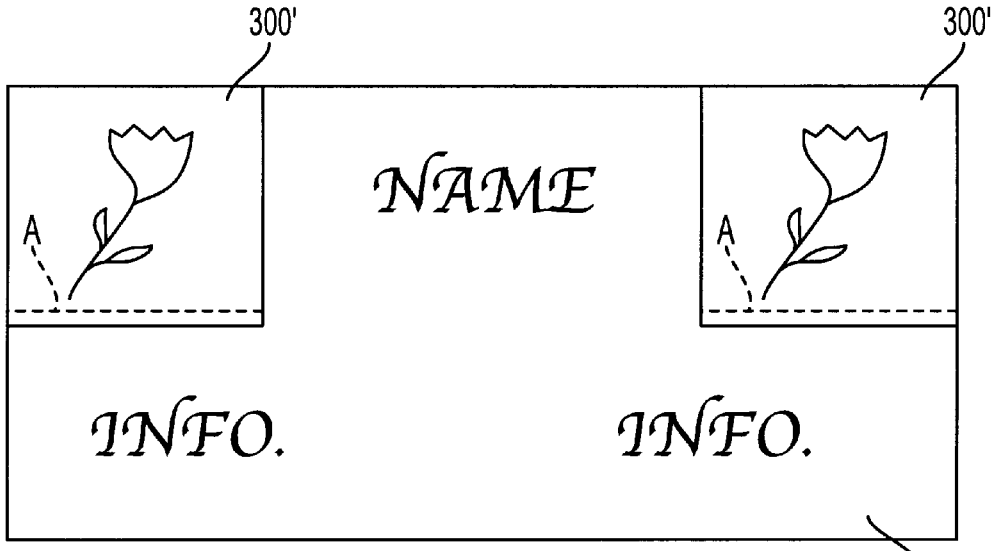
FIG. 10(B) is a top view of another embodiment similar to that shown in FIG. 10(A) having two pivoted receptacles.

FIG. 10(B) shows an embodiment similar to that shown in FIG. 10(A) having two such receptacles 300' that are each mounted to pivot around axes A as shown. It should be understood that any number of such receptacles can be included. Similarly, although other embodiments herein illustrate single receptacles, any of the embodiments described herein can include a plurality of receptacles—of one or more type as well.

Figure 11C:
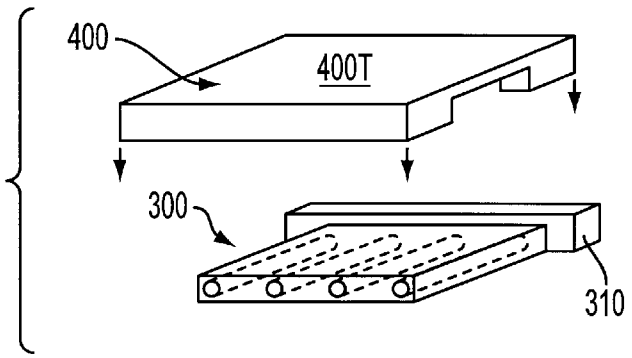
FIG. 11(C) is a schematic perspective view showing the relationship between the cover plate and the receptacle shown in FIG. 11(A)
Figure 11D:
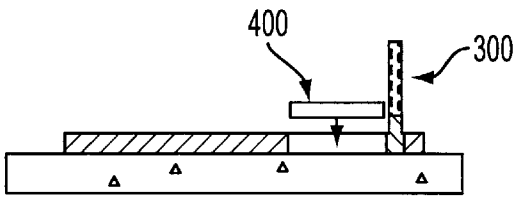
FIG. 11(D) is a cross-sectional side view taken along the arrows A—A in FIG, with the cover plate being placed thereon.
Figure 11A:
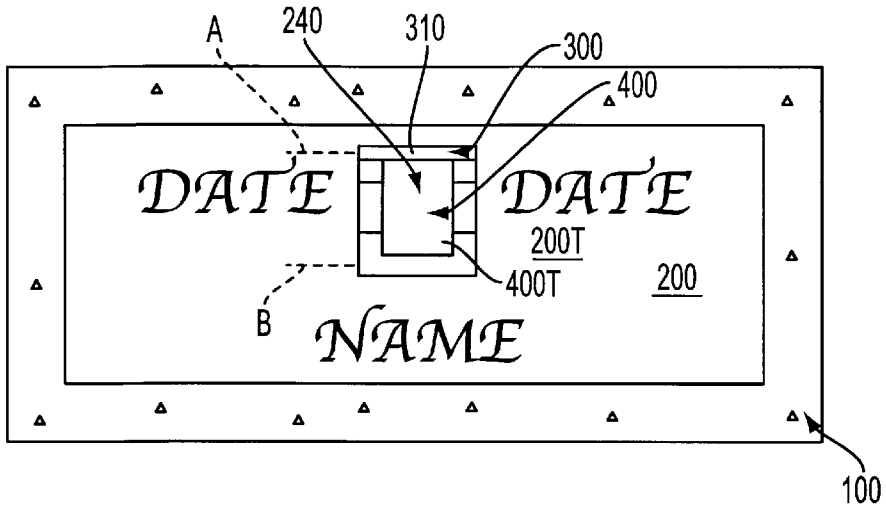
FIG. 11(A) is a top view of another embodiment of the invention wherein the marker includes an upper recess that receives the receptacle and a cover plate, with the receptacle in a stored position.
Figure 11B:
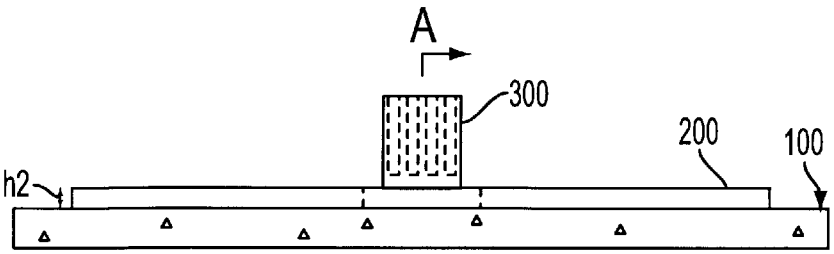
FIG. 11(B) is a side view of the embodiment shown in FIG. 11(A) with the receptacle in an erect position.
Figure 11E:
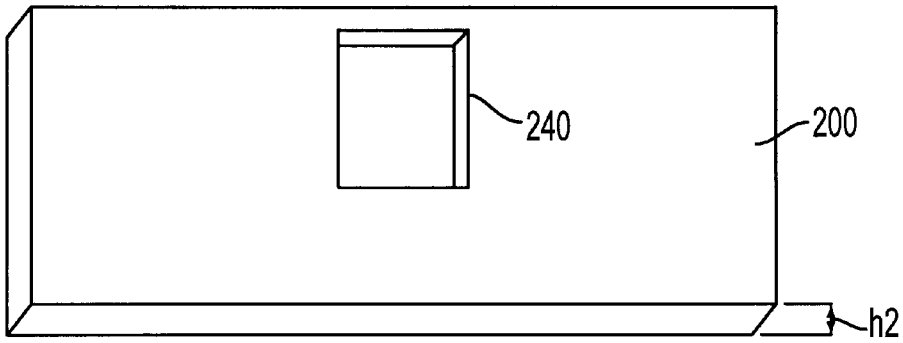
FIG. 11(E) is a top perspective view of the marker shown in FIG. 11(A)
Figure 11F:
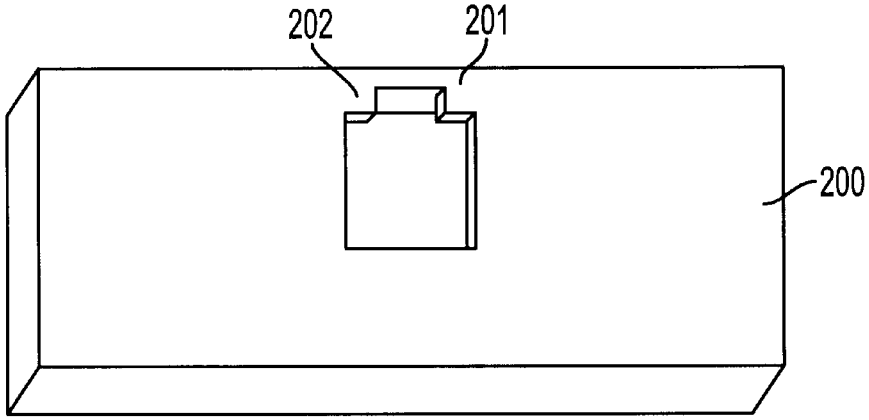
FIG. 11(F) is a top perspective view of a modified version of the marker shown in FIG. 11(E)
Figure 11G:
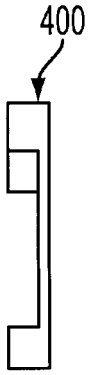
FIG. 11(G) is a side view of the cover plate shown in FIG. 11(A)
Figure 11H:
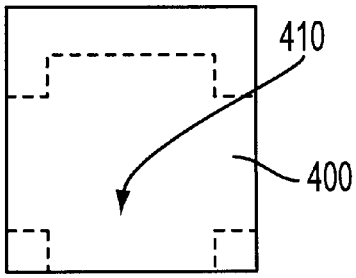
FIG. 11(H) is a bottom view of the cover plate shown in FIG. 11(A).

FIGS. 11(A)–11(H) illustrate additional alternative embodiments of the invention wherein the marker 200 includes a central cutout section 240 which receives the receptacle 300 and a cover plate 400. As shown in FIG. 11(E), the central cut out section 240 is preferably a generally rectangular hole extending at least partly through the height h2 of the member 200. In order to store the receptacle 300, the receptacle is laid down within the cutout section 240 with the base 310 adjacent one side as shown in FIG. 11(A), then the cover plate 400 is placed over the receiving member 320 of the receptacle 300. As best shown in FIGS. 11(A) and 11(H), the cover plate 400 is preferably formed with a cutout interior area 410 that receives the receiving member 320 of the receptacle 300.

In this manner, the base 310 of the receptacle 300 is visible and the top of the cover plate 400 is visible when the receptacle 300 is stored. That is, the cover plate 400 preferably covers the entire area of the cutout section 240 except for a region over the base 310.

In order to erect the receptacle, the cover plate 400 can be removed, the receptacle 300 can be rotated to a vertical position, and then the cover plate 400 can be returned to the cutout section 240 to retain the receptacle in the vertical position as shown in FIG. 11(D). In this manner, the marker 200 retains a pleasant appearance both when the receptacle is stored as well as when the receptacle is erected.

FIG. 11(F) shows a modification of the embodiment shown in FIG. 11(A), wherein the marker 200 includes two overhanging tabs 201 and 202 at one end of the cutout section 240. The tabs 201 and 202 are similar to the tabs 220' shown in FIG. 5. In this regard, the receptacle 300 can be placed in the cutout section 240 with the base 310 under the tabs 201 and 202 and with the receiving member 320 under the cover plate 400 in the stored position. Then, the cover plate 400 can be removed and the base 310 can be slid laterally from under the tabs. Then, the receptacle 300 can be erected and the base 310 can again be slid under the tabs while in an erect orientation. Then, the cover plate 400 can be returned to its supporting position to fixedly maintain the receptacle in its erect position.

In another modification of this latter embodiment, the receptacle 300 can be mounted to pivot about an axis A shown in dashed lines in FIG. 11(A) extending through the base 310, while the cover plate 400 can be mounted to pivot about an axis B shown in dashed lines in FIG. 11(A). In this latter case, in order to erect the receptacle 300, the cover plate 400 can be pivoted upward to uncover the receiving member 320, then the receptacle 300 can be pivoted upward to a vertical position. Once the receptacle is in the vertical position, the cover plate 400 can be pivoted back down to its lowered position to retain the receptacle in its vertical position.

In other alternative embodiments, the cover plate 400 can also be mounted on a slide track (not shown) that is laterally slid to enable removal of the receptacle and laterally slid to return to a storage/covering position after the receptacle is erected.

As with the embodiments shown in FIGS. 10(A) and 10(B), the generally horizontal top surface 400T of the cover plate 400 can be generally flush with the generally horizontal top surface 200T of the marker 200, but the top surface 400T can also be raised slightly above the top surface 200T or can even be slightly recessed there below. Among other things, raising the top surface 400T can facilitate manual manipulation. It is also contemplated that in other much less preferred versions of the embodiments shown in FIGS. 2–9, the bore 210 could actually extend through the upper surface (i.e., the broad viewing surface) of the marker so that the receptacle is at least partly visible or protrudes from the upper surface when in the stored position.

In the embodiments shown in FIGS. 10(A)–10(B) and 11(A)–11(G), when in their stored positions, the receptacles preferably have receiving members 320 that extend generally in a direction RA, see for example FIG. 10(A), substantially parallel to the broad surface, i.e., the broad viewing surface, of the marker. Once again, the receiving members 320 preferably have concavities or receiving bores extending generally parallel to the direction RA which can receive flower stems or the like when the receptacle is erected. In this manner, when the marker has a minimal height h2, a receptacle 300 having a substantial size can still be retained by the marker 200.

Although the preferred embodiments of the invention do not require any modification of the foundation in order to retain the receptacle 300, it is contemplated that in less preferred embodiments—and especially in variations of the embodiments shown in FIGS. 9–11—the foundation can include a recess or can be shaved down partly beneath the receptacle storage position of the marker to accommodate a wider receptacle. Although this modification of the foundation is less preferred and somewhat costly, it is still substantially preferable over existing devices (discussed above) wherein vertical through-holes are drilled entirely through the height h1 of the foundation. This modification of the foundation can be done with granite foundations or with other foundations.

Although the preferred embodiments of the invention include a marker that is supported upon a foundation, it is contemplated that in alternative less preferred embodiments, the foundation can be eliminated and the marker can be used without such a foundation while still retaining the capability of supporting such a receptacle or the like.

In the most preferred embodiments of the invention, the receptacle is used to support flowers upon the memorial. Each of the preferred embodiments can be modified, however, to have the receptacles contain other items, such as letters, pictures or other items. When flowers are supported by the receptacles, the receptacles preferably include concavities or bores that can receive stems of the flowers and that can also contain a quantity of water to help preserve the flowers if desired.

While the present invention has been described with reference to the preferred embodiments of the invention, it is contemplated that the same can be varied as would be apparent to those skilled in the art based on this disclosure without departing from the spirit and scope of the invention. Any and all such modifications are intended to be included within the scope of the following claims. As some exemplary modifications, various aspects of the preferred embodiments of the invention can be combined together where appropriate.

What is claimed is:

1. A memorial, comprising:

a) a marker having an upper surface with memorial markings thereon;

b) said marker including a lateral receiving hole formed in a side of said marker;

c) a receptacle having a length extending along a first axis with at least one concavity or bore extending along said first axis, said receptacle being retained in said receiving hole in a stored position with said first axis generally parallel to said upper surface; and d) said receptacle being removable from said receiving hole and configured to remain in an erect position wherein said receptacle extends from said receiving hole with said first axis generally perpendicular to said upper surface.

2. The memorial of claim 1, where said upper surface is generally flat.

3. The memorial of claim 1, wherein said marker is made with metal.

4. The memorial claim 1, wherein said marker is made with bronze.

5. The memorial of claim 1, wherein said receptacle has a base and a receiving member extending from said base.

6. The memorial of claim 1, further including means for stabilizing said receptacle in said erect position.

7. The memorial of claim 1, further including a foundation upon which said marker is mounted.

8. The memorial of claim 7, wherein said foundation is free of any holes beneath said receiving hole in said marker.

9. A memorial, comprising:

a) a marker having an upper viewing surface with memorial markings thereon, b) said marker including a receiving hole, c) a receptacle having a length extending along a first axis with at least one concavity or bore extending along said first axis, said receptacle being retained in said receiving hole in the stored position of said receptacle, d) said receptacle being removable from the receiving hole and configured to remain in an erect position wherein said receptacle extends from said receiving hole, and e) a separate cover plate for covering at least a portion of said receptacle in said stored position, wherein said cover plate is also configured to support said receptacle in said erect position.

* * * * *